United States Patent [19]

Florjancic et al.

[11] 4,177,008

[45] Dec. 4, 1979

[54] CENTRIFUGAL PUMP

[75] Inventors: Dusan Florjancic, Winterthur, Switzerland; Heinz-Bernd Matthias, Frankenthal, Fed. Rep. of Germany

[73] Assignee: Klein, Schanzlin & Becker Aktiengesellschaft, Frankenthal, Fed. Rep. of Germany

[21] Appl. No.: 866,933

[22] Filed: Jan. 4, 1978

Related U.S. Application Data

[63] Continuation of Ser. No. 622,017, Oct. 14, 1975, abandoned, which is a continuation-in-part of Ser. No. 436,689, Jan. 25, 1974, abandoned.

[30] Foreign Application Priority Data

Jan. 26, 1973 [DE] Fed. Rep. of Germany ..... 2303718

[51] Int. Cl.[2] ..... F04D 29/42

[52] U.S. Cl. ..... 415/206; 417/219

[58] Field of Search ..... 415/DIG. 7, 211, 219 C; 417/424

[56] References Cited

U.S. PATENT DOCUMENTS

| | | | |
|---|---|---|---|
| 3,467,015 | 9/1969 | Allan | 415/211 |
| 3,476,488 | 11/1969 | Chambert | 415/219 C |
| 3,779,667 | 12/1973 | Johnson | 415/211 |
| 3,859,008 | 1/1975 | Weiser | 415/219 C |
| 3,874,813 | 1/1975 | Honald | 415/219 C |
| 3,910,714 | 10/1975 | Allan | 415/219 C |
| 3,947,154 | 3/1976 | Klepp | 417/424 |

FOREIGN PATENT DOCUMENTS

| | | | |
|---|---|---|---|
| 124621 | 5/1931 | Austria | 415/DIG. 7 |
| 178014 | 3/1966 | U.S.S.R. | 415/DIG. 7 |

*Primary Examiner*—William L. Freeh

*Attorney, Agent, or Firm*—Michael J. Striker

[57] ABSTRACT

A primary recirculating pump for pressurized water or boiling water nuclear reactors has a spherical housing with a radially extending integral outlet, a rotary impeller which is insertable or removable through a sealable opening of the housing, and a composite inlet including an outer section which is integral with the housing and a discrete inner section which is insertable and removable through the opening and serves to convey to the impeller, and to preferably accelerate, the fluid which enters through the outer section. The inner section may resemble a bend or a funnel which diverges from the impeller toward the outer section, and the outer section may resemble a bend, a substantially straight pipe which extends tangentially of the housing, or a helical or semihelical conduit. The plane of the outer section is closely adjacent to or even coincides with the plane of the outlet, especially when the outer section is tangential to the housing or resembles a portion of or an entire helix.

9 Claims, 7 Drawing Figures

CENTRIFUGAL PUMP

CROSS REFERENCE TO RELATED APPLICATIONS

This is a continuation of application Ser. No. 622,017, filed Oct. 14, 1975, now abandoned. Application Ser. No. 622,017 is a continuation-in-part of the copending application Ser. No. 436,689, filed Jan. 25, 1974.

The centrifugal pump of the present invention constitutes an improvement over and a further development of the pump which is disclosed in the commonly owned copending applications Ser. No. 411,382, now abandoned, filed Oct. 31, 1973 and Ser. No. 436,689 filed Jan. 25, 1974, now abandoned, both by Matthias et al.

BACKGROUND OF THE INVENTION

The present invention relates to improvements in centrifugal pumps in general, and more particularly to improvements in centrifugal pumps which can be used for circulation of coolant in nuclear reactor plants, especially as primary recirculating pumps in pressurized water and boiling water nuclear reactors.

It is already known to provide the primary recirculating pump in a nuclear reactor plant with a spherical housing having an inlet for incoming fluid and an outlet for pressurized fluid. It is further known to assemble the inlet of two sections one of which is integral with the housing and the other of which is coaxial with the impeller or rotor. Reference may be had to German printed publication No. 1,653,785. A drawback of the pump which is disclosed in this publication is that the housing has a semispherical shape or resembles a cylindrical shell. This reduces the stability of the housing. Moreover, the outer section of the inlet is a pipe elbow which extends along an arc of 90 degrees so that it contributes excessively to the overall space requirements of the pump and necessitates the circulation of excessive quantities of fluid. It has been found that excessive pressure peaks develop in the region where the elbow of the inlet communicates with the interior of a semispherical or cylindrical (shell-shaped) pump housing. Moreover, the distance between the plane of the fluid-receiving end of the outer section of the inlet and the outlet is quite substantial which necessitates the circulation of large quantities of fluid in the interior of the pump. Therefore, the pump which is disclosed in the aforementioned publication failed to gain acceptance in the industry and is not in actual use.

The commonly owned copending application Ser. No. 411,382 of Matthias et al. discloses a centrifugal pump wherein the pressure housing resembles a ring-shaped or spiral insert which is installed in an outer housing, and wherein the plane of the inlet coincides with the plane of the outlet. This is achieved by greatly increasing the dimensions of the pressure housing in a direction at right angles to the axis of the impeller. The pressure housing has a conical central portion which conveys fluid into the range of the rotary impeller. The outlet has a portion which extends through the pressure housing. A drawback of such construction is that the pressure housing is a ring or spiral whose stability does not match that of a hollow sphere.

SUMMARY OF THE INVENTION

An object of the invention is to provide a novel and improved centrifugal pump which can be used with advantage as a primary recirculating pump in pressurized water or boiling water nuclear reactors, especially at elevated pressure and/or temperatures.

Another object of the invention is to provide a compact centrifugal pump having a spherical or substantially spherical stress-resistant housing with a novel and improved inlet for admission of fluid into the range of the rotary impeller.

A further object of the invention is to provide a centrifugal pump wherein the inlet can be placed into or close to the plane of the outlet to thus reduce the quantity of fluid to be circulated.

An additional object of the invention is to provide a centrifugal pump having a spherical housing with a composite inlet a portion of which is located in the housing but is nevertheless readily accessible for inspection, replacement or repair.

The invention is embodied in a centrifugal pump, particularly in a primary recirculating pump for use in pressurized water or boiling water nuclear reactors. The pump comprises a spherical or substantially spherical hollow pump body or housing, an impeller which is rotatable in the housing, an inlet having an outer section which is rigid (preferably integral) with the housing and is inclined with respect to the axis of the impeller and a discrete inner section which is installed in the housing to convey inflowing fluid from the outer section into the range of the impeller, and an outlet which serves to convey pressurized fluid from the housing and may be integral with and preferably extends radially from the housing.

At least one of the two sections of the inlet may constitute a bend and the inner section is preferably insertable into and removable from the interior of the housing through a sealable opening which serves for insertion or removal of the impeller.

The inner section of the inlet may be configurated to accelerate the flow of fluid from the outer section toward the impeller. If the outer section is a bend, it can cooperate with the housing to effect a spiral flow of fluid. Alternatively, the outer section may extend tangentially of the housing or it may assume a helical or semihelical shape; the inner section of the inlet then preferably constitutes a hollow funnel or cone which tapers in a direction from the outer section toward the impeller. A funnel-shaped or conical inner section can be installed in the spherical housing in such a way that its axis coincides with the axis of rotation of the impeller.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
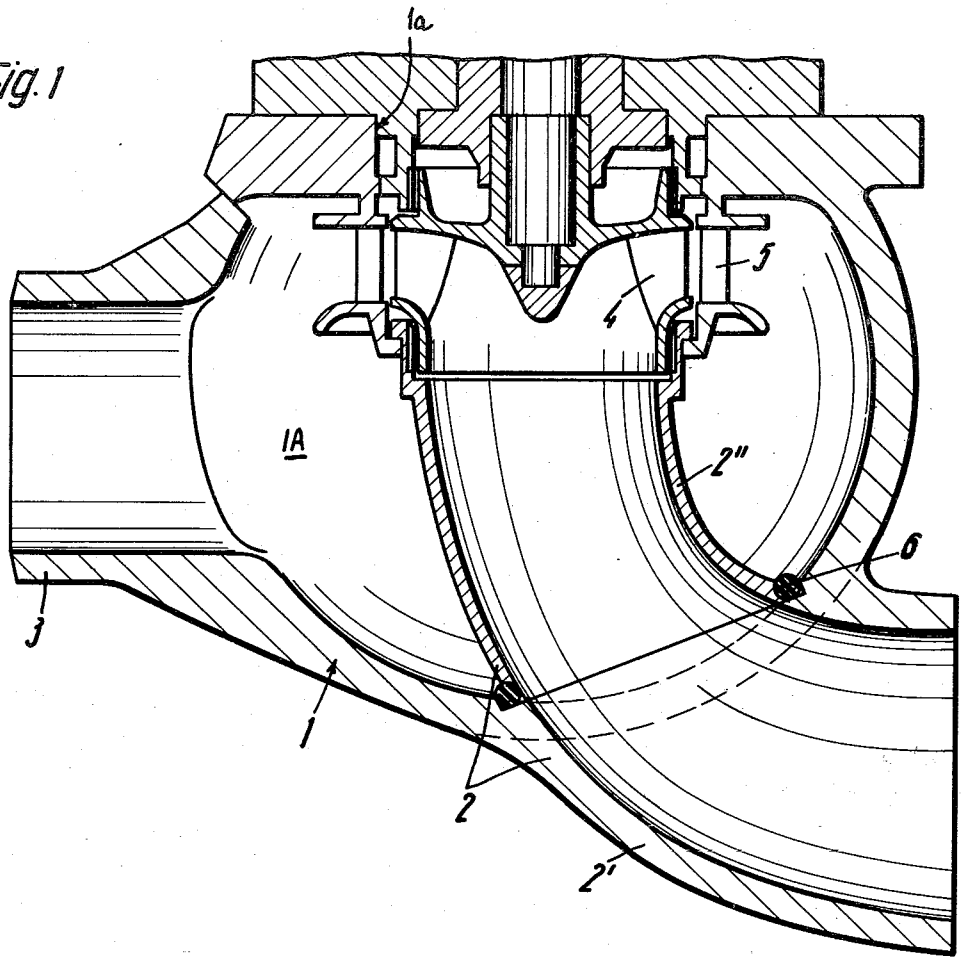
FIG. 1 is a fragmentary axial sectional view of a centrifugal pump which embodies one form of the invention and wherein the inner section of the inlet constitutes a bend.

FIG. 1 shows a centrifugal pump having a substantially spherical hollow housing or body 1 provided with a radially extending outlet 3 for pressurized fluid and a composite inlet 2 for admission of fluid. The inlet 2 comprises a curved outer section or bend 2' which is integral with the housing 1 and a discrete curved inner section or bend 2" which is inserted into the interior of the housing 1 and constitutes an extension of the outer section 2'.

The upper part of the housing 1, as viewed in FIG. 1, has a normally sealed opening 1*a*, through which the section 2" of the inlet 2 can be inserted or removed. Sealing means 6 (e.g., one or more piston rings) is provided to seal the outer end of the section 2" from the chamber 1A for highly pressurized fluid. The chamber 1A communicates with the outlet 3.

The rotary impeller or rotor 4 of the pump is insertable into and removable from the housing 1 through the sealable opening 1*a* and is surrounded by a composite guide 5 which directs fluid into the chamber 14. The guide 5 is secured to or made integral with the housing 1. If the section 2" is rather large, the guide 5, preferably consists of several portions which are separable from each other and at least some of which are separable from the housing 1 so as to allow for an enlargement of the opening 1*a* in order to facilitate insertion or removal of the section 2". The discharge end of the section 2" is sealingly connected to the adjacent portion of the guide 5. It will be noted that the inlet 2 is inclined with respect to the axis of the impeller 4.

The plane of the outer section 2' of the inlet 2 is closely adjacent to the plane of the outlet 3. As shown, the upper portion of the outer section 2' is at or very close to the level of the lower portion of the outlet 3. It is within the purview of the invention to modify the pump of FIG. 1 in such a way that the upper portion of the outer section 2' is located above the level of the lower portion of the outlet 3.

Figure 2:
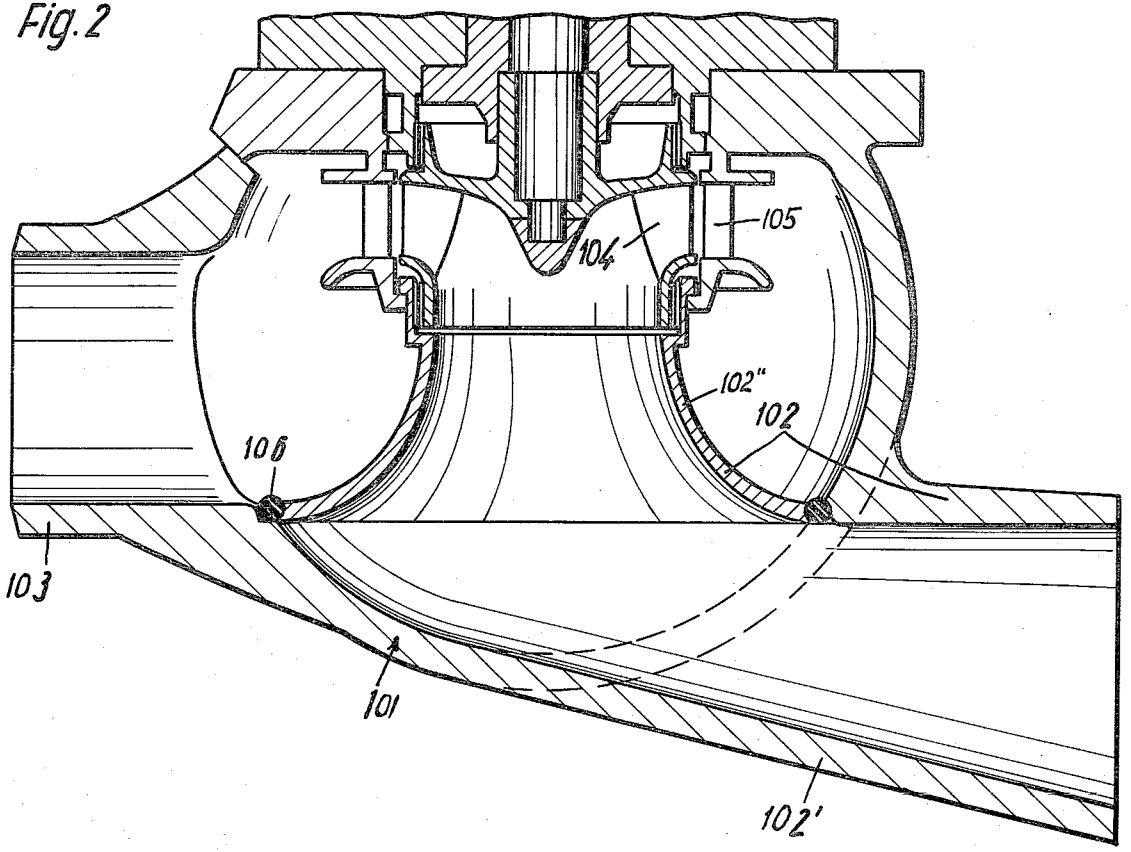
FIG. 2 is a similar fragmentary axial sectional view of a second centrifugal pump wherein the outer section of the inlet is substantially tangential to the housing and the inner section constitutes a hollow cone.

The centrifugal pump of FIG. 2 employs a composite inlet 102 having an outer section 102' which is substantially tangential to the hollow spherical housing 101 and a hollow conical or funnel-shaped inner section 120" whose cross-sectional area decreases gradually from the sealing means 106 toward the connection with the guide 105. The outlet is shown at 103, and the impeller at 104. It will be noted that, here again, the outer section 102' of the inlet 102 is inclined with respect to the axis of the impeller 104. The inner section 102" may but need not be coaxial with the impeller. The plane of the section 102' is closely adjacent to the plane of the outlet 103. In fact, the upper portion of the section 102' can be said to be located at the level of the lower portion of the outlet 103.

Figure 3:
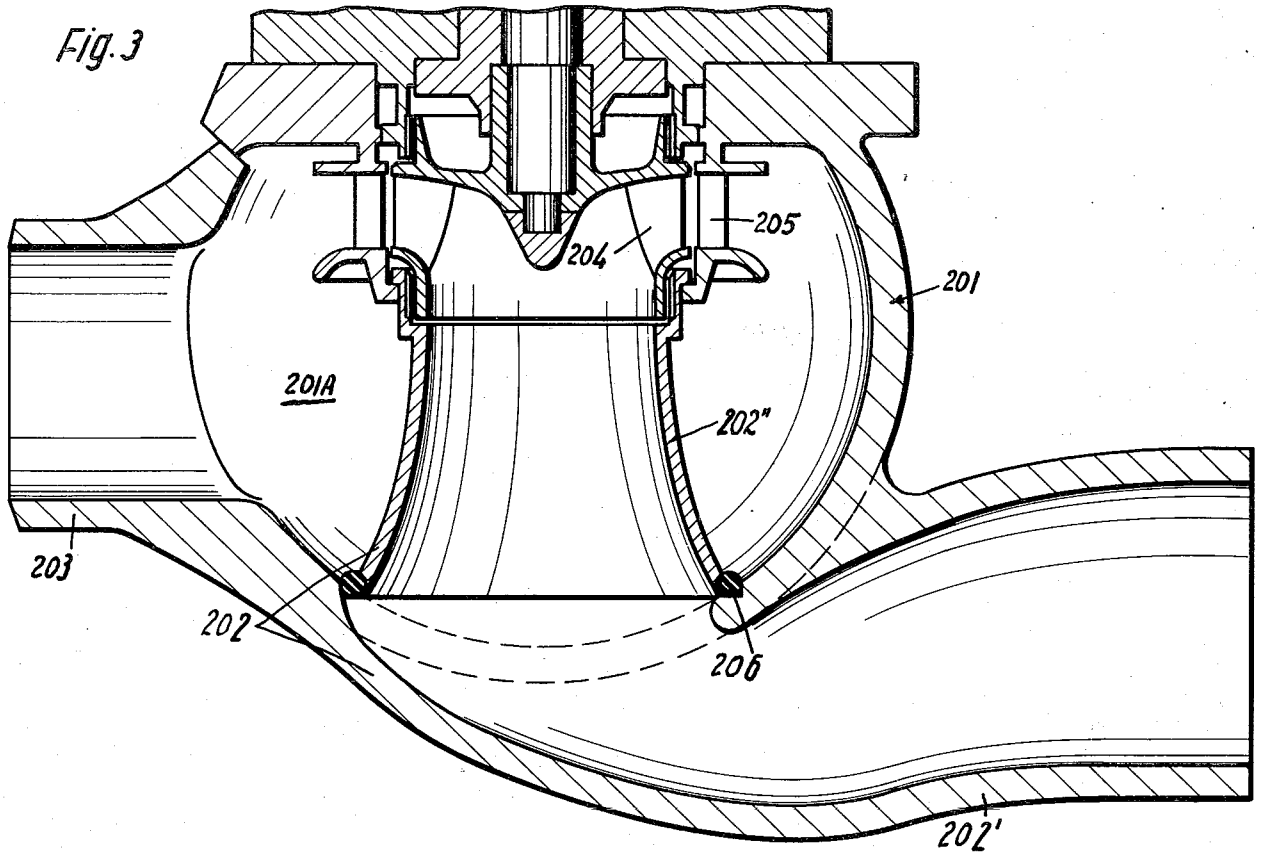
FIG. 3 is a similar fragmentary axial sectional view of a centrifugal pump which constitutes a modification of the pump shown in FIG. 2 and employs an inlet having a spiral or semihelical outer section.

In the centrifugal pump of FIG. 3, the composite inlet 202 has a helical or semihelical outer section 202' which is integral with the hollow spherical housing 201 and is inclined with respect to the axis of the impeller 204, and a hollow conical or funnel-shaped inner section 202" which is coaxial with the impeller and diverges in a direction from the guide 205 toward the outer section 202'. The sealing means for the lower end of the inner section 202" is shown at 206, and the outlet is shown at 203.

In FIG. 3, at least a portion of the outer section 202" can be placed into or close to the plane of the outlet 203. As shown, the upper portion of the section 202' is located at or slightly above the level of the lower portion of the outlet 203.

In each of the illustrated embodiments the inner section (2", 102" or 202") of the composite inlet may consist of two or more tubular portions which are assembled and configurated in such a way that they are urged against each other in response to the action of pressurized fluid in the respective housing. For example, the section 202" of FIG. 3 may consist of two coaxial rings one of which is partially telescoped into the other and is urged into the other ring by fluid in the pressure chamber 201A.

Figure 5:
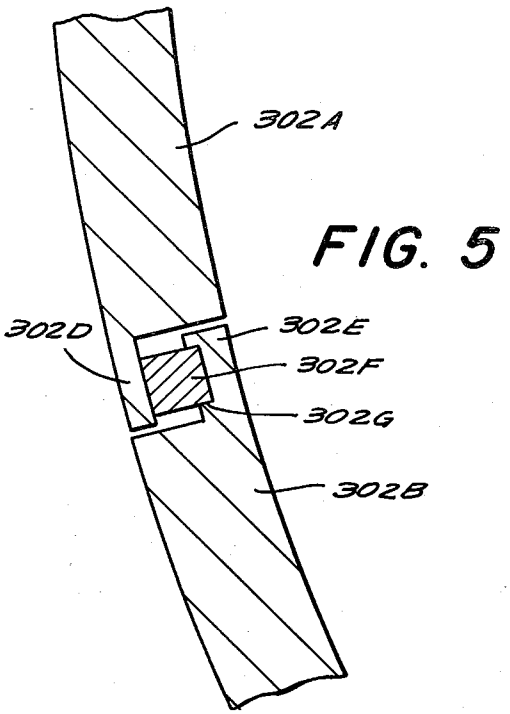
FIG. 5 is an enlarged view of a detail within the circle V shown in FIG. 4.
Figure 4:
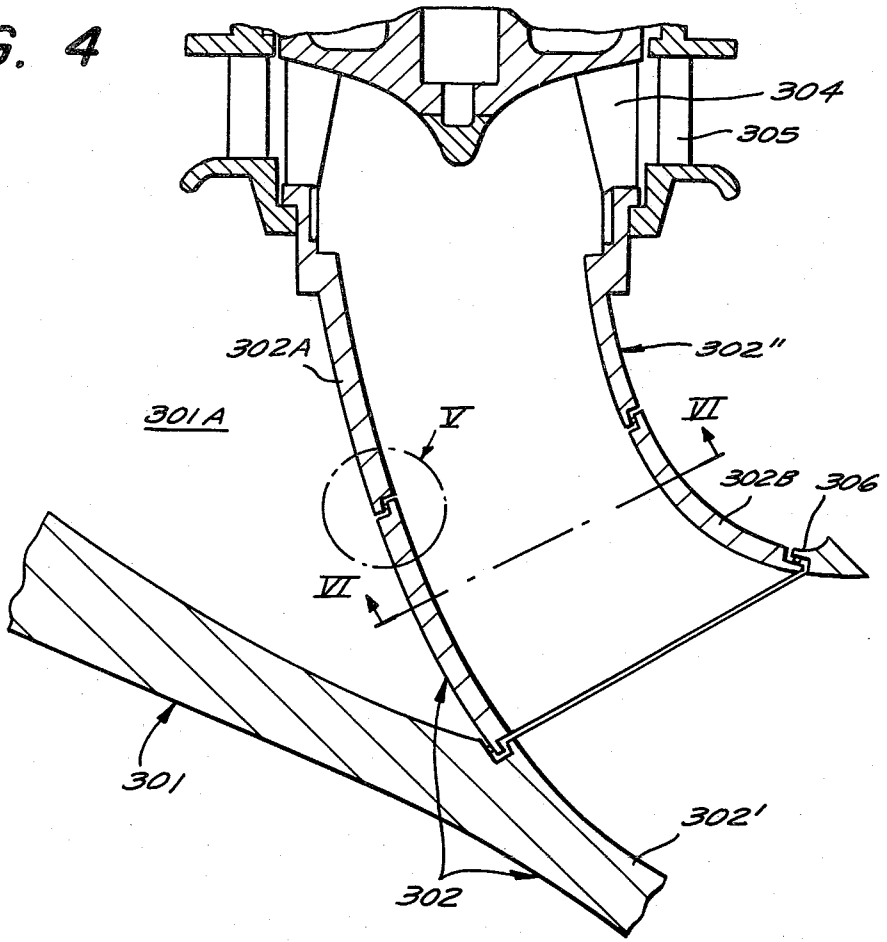
FIG. 4 is a fragmentary axial sectional view of a pump which constitutes a modification of the pump shown in FIG. 1.

FIG. 4 shows a portion of a pump having a spherical housing 301, a composite inlet 302 including an outer section 302' and an inner section 302", an outlet (not shown but preferably similar to outlet 3 of FIG. 1), an impeller 304, a one-piece or composite guide 305, and sealing means 306. The inner section 302" of the inlet 302 consists of two tubular portions 302A, 302B which are disposed substantially end-to-end but are partially telescoped into each other in a manner shown in FIG. 5. Thus, the portion 302A has an annular flange 302D which surrounds with clearance an annular flange 302E of the portion 302B. A ring-shaped sealing element 302F is placed between the flanges 302D, 302E. A portion of the sealing element 302F can be received in an annular groove 302G machined into the outer surface of the flange 302E.

Figure 6:
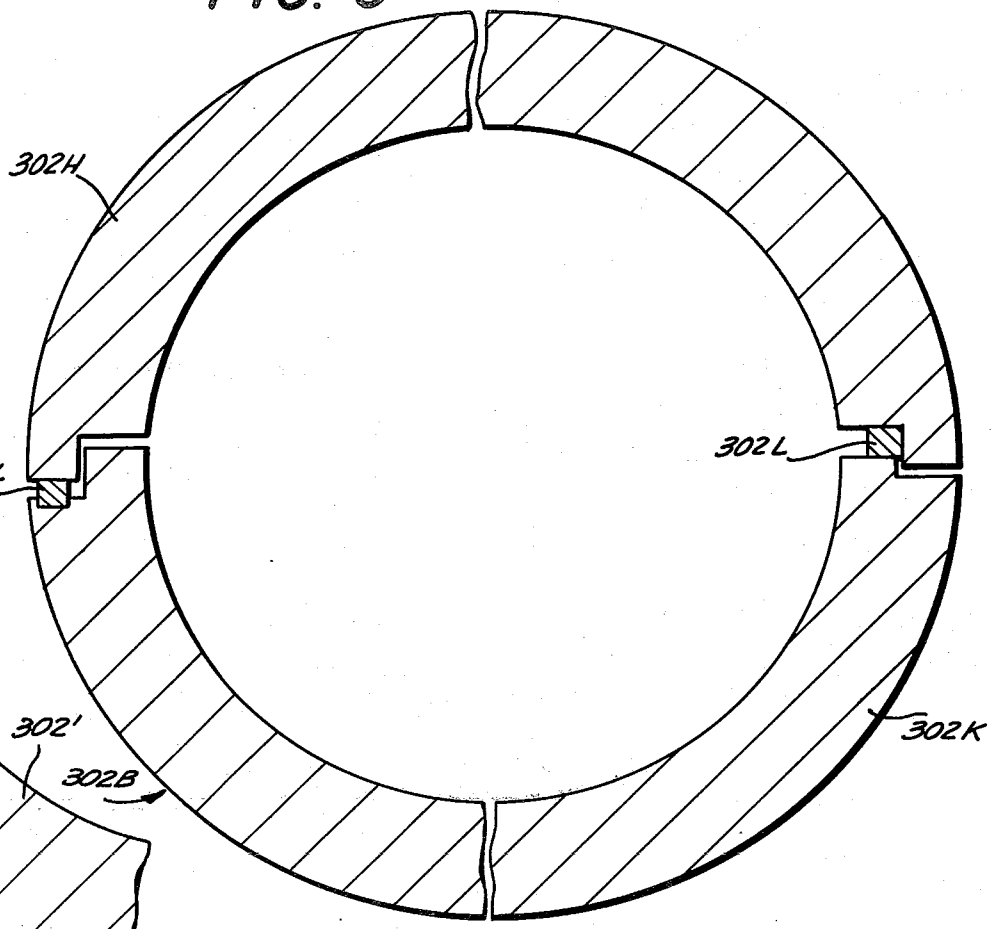
FIG. 6 is a sectional view as seen in the direction of arrows from the line VI—VI of FIG. 4.

FIG. 6 shows that at least one of the tubular portions 302A, 302B (e.g., the bulkier portion 302B) may be assembled of several (for example two) substantially semicylindrical components or shells 302H, 302K with elongated sealing elements 302L therebetween. The portions 302A, 302B and components 302H, 302K are held together by pressurized fluid in the chamber 301A of the housing 301. The just described construction of the inner section 302" renders it possible to insert or remove the constituents of this section by way of the opening (not shown in FIG. 4 but corresponding to the opening 1*a* of the housing 1) of the housing 301, especially if the guide 305 is at least partially separable from the housing 301 and/or if the tubular portion 302A also consists of two or more discrete components corresponding to components 302H, 302K of the tubular portion 302B.

Figure 7:
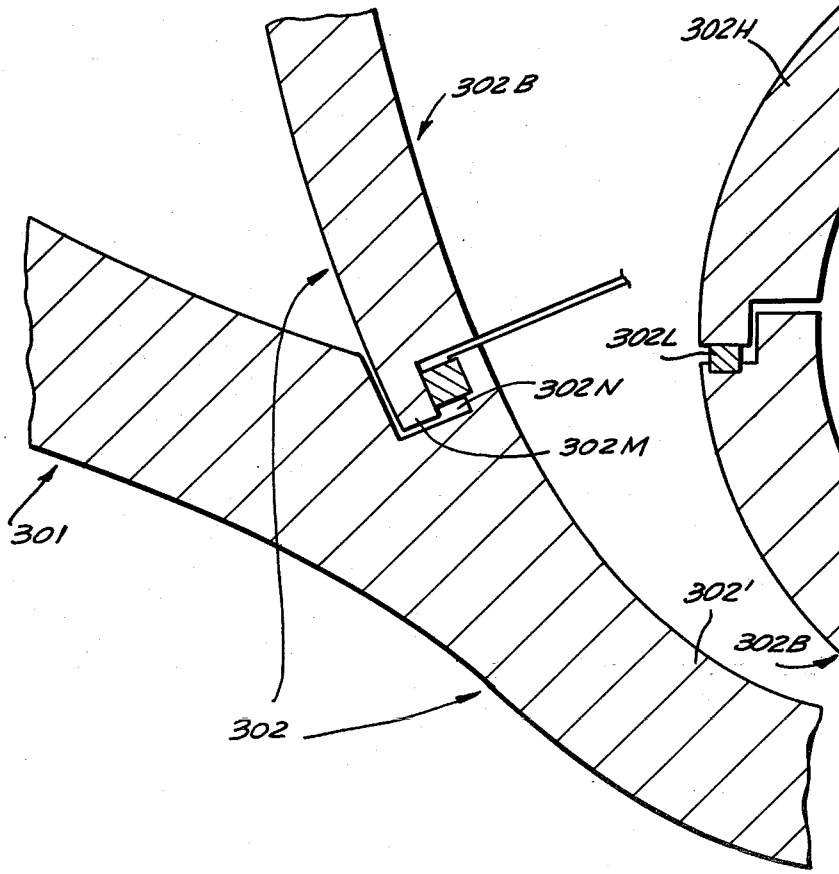
FIG. 7 is a sectional view of connection between the inner and outer sections of the inlet shown in FIG. 4.

FIG. 7 shows that the outermost part of the tubular portion 302B has an annular extension of flange 302M which extends into an annular groove 302N at the junction of the housing 301 and section 302'. The sealing means 306 is located in the groove 302N and is surrounded by the flange 302M.

As mentioned above, the inner section 102" or 202" can also consist of two or more tubular portions and one or more tubular portions of each such inner section may consist of two or more shells to facilitate the insertion or removal of inner section from the respective chamber.

The pump of the present invention is particularly suited for use at elevated temperatures (e.g. up to and in excess of 300° C.) and/or elevated pressures (e.g., in excess of 170 bar), for example, in a nuclear reactor plant. One of its advantages resides in that the desirable spherical shape of the housing can be retained for reasons of greater stability while at the same time reducing the volume of fluid to be circulated in the housing. This is achieved in part by designing the inlet and the outlet in such a way that the distance between the planes of the inlet and outlet is as small as possible. More particularly, such desirable positioning of the plane of the inlet with respect to the plane of the outlet is achieved by causing the outer section 2', 102', 202' or 302' of the inlet to extend from the housing 1, 101, 201 or 302 at an angle to the pump axis (axis of the impeller 4, 104, 204, or 304) and by imparting to the inner section 2", 102", 202" or 302" the shape of a bend or funnel, preferably a bend or funnel which effects an acceleration of fluid flowing into the range of the rotating impeller. The configuration of the inner section 2", 102", 202" or 302" (eventually in combination with a suitable selection of the shape of the pump housing) contributes to generation of a desirable spiral effect.

Another advantage of the improved pump is the compactness of the inner section 2", 102", 202" or 302" of the inlet. This, combined with the preferably assymetric mounting of the inner section with respect to the housing (see particularly FIG. 1 or 4) also contributes to a reduction of the distance between the levels of the inlet and outlet with the aforediscussed advantage that the volume of fluid in the pump is reduced well below the volume in conventional pumps while the housing exhibits a substantially spherical shape to insure a desirable rigidity and stability at elevated temperatures and/or pressures.

The provision of a bent inlet constitutes a radical departure from the presently prevailing practice of constructing coolant circulating pumps for use in nuclear reactor plants or the like. Due to stringent regulations regarding the safety of such plants, it was considered necessary to employ in a pump with a spherical housing an inlet which is fully symmetrical with respect to the pump axis and whose outer section curves gradually toward the point of communication with the housing. This was also considered necessary for the inner section of the inlet provided that the inlet consisted of an inner and an outer section. Such practice is prevalent in presently known coolant circulating pumps for nuclear reactor plants because of the opinion of experts that a departure from symmetrical mounting of the inlet with respect to the pump axis would induce non-uniform distribution of fluid velocities upstream of the impeller which would result in unequal stressing of and in the generation of radial forces acting on the impeller so that the impeller would tend to vibrate. The fact that the just described conventional configuration of the inlet invariably results in the circulation of much larger quantities of coolant was considered as an undesirable but unavoidable characteristic of pumps with a spherical housing and a symmetrically arranged inlet for inflowing fluid.

In contrast to such conventional practice, the pump of the present invention employs the desirable spherical or generally spherical housing but the configuration and construction of the inlet depart radically from conventional designs. The provision of a composite inlet, a discrete section of which is installed in the housing proper, renders it possible to change the direction of flow of incoming fluid in the interior of the housing (i.e., in the bent or conical inner section 2", 102", 202" or 302") and to even further reduce the dimensions of the housing. This contributes to a surprisingly pronounced reduction in the volume of circulating coolant and in a corresponding reduction of the outlay for circulation of coolant. Based on careful calculations of forces and stresses which develop in actual use of the improved pump, as well as on extensive experiments, it has been found that the pump fully achieves the aforestated objects while retaining the desirable spherical or substantially spherical shape of the housing. The inflowing fluid stream is accelerated without subjecting the impeller to radial stresses.

In the pump of FIG. 2 wherein the outer section 102' of the inlet 102 extends tangentially of the housing 101, the deflection of incoming fluid stream is effected by the housing and the funnel-shaped inner section 102". As mentioned before, the provision of a tangential outer section 102' renders it possible to further reduce the distance between the planes of the inlet 102 and outlet 103.

An advantage of the pump which is shown in FIG. 3 is that the distance between the planes of the inlet 202 and outlet 203 can be reduced still further; in fact, the provision of an inlet with a helical or semihelical outer section 202' renders it possible to reduce the distance between the plane of the inlet 202 and outlet 203 to zero. The taper of the inner section 202" in the pump of FIG. 3 is shown as being somewhat less pronounced than that of the inner section 102" shown in FIG. 2.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. In a centrifugal pump, particularly in a primary recirculating pump for use in pressurized water and boiling water nuclear reactors, a combination comprising a substantially spherical hollow pump housing having a sealable opening; an impeller rotatable in said housing; an inlet having an outer section which is rigid with said housing and inclined with respect to the axis of said impeller and which has a discharge port for inflowing fluid, and a discrete inner section installed in said housing to receive inflowing fluid from said discharge port of said outer section and to convey the fluid into the range of said impeller, said inner section comprising a plurality of axially adjacent communicating tubular portions, said impeller and said inner section of said inlet being removable from said housing by way of said opening; and an outlet for conveying pressurized fluid from said housing, the plane of said discharge port of said outer section of said inlet being at least closely adjacent to said outlet.

2. In a centrifugal pump, particularly in a primary recirculating pump for use in pressurized-water and boiling-water reactors, a combination comprising a substantially spherical hollow pump housing having a circumferential wall provided with an inlet opening, a sealable opening substantially opposite said inlet opening and an outlet opening intermediate said sealable opening and said inlet opening and being at least close to the plane of the latter; an impeller rotatable in said housing inwardly adjacent said sealable opening and spaced from said inlet opening; and an inlet structure having an outer section which is rigid with said housing and inclined with respect to the axis of said impeller and which communicates with the said inlet opening at the outer side of said housing, and a discrete inner section installed in said housing in communication with said inlet opening and having a flow passage extending from said wall towards said impeller, and at least in part converging in direction towards said impeller to convey incoming fluid into the range of the same, said inner section comprising a plurality of axially adjacent communicating tubular portions at least one of which consists of a plurality of discrete components, and said inner section and impeller both being removable from said housing by way of said sealable opening.

3. In a centrifugal pump, particularly in a primary recirculating pump for use in pressurized-water and boiling-water reactors, a combination comprising a substantially spherical hollow pump housing have a circumferential wall provided with an inlet opening, a sealable opening substantially opposite said inlet opening and an outlet opening intermediate said sealable opening and said inlet opening and being at least close to the plane of the latter; an impeller rotatable in said housing inwardly adjacent said sealable opening and spaced from said inlet opening; and an inlet structure having an outer section which is integral with said housing and inclined with respect to the axis of said impeller and which communicates with the said inlet opening at the outer side of said housing, and a discrete inner section installed in said housing in communication with said inlet opening and having a flow passage extending from said wall towards said impeller, and at least in part converging in direction towards said impeller to convey incoming fluid into the range of the same, said inner section comprising a plurality of axially adjacent communicating tubular portions at least one of which consists of a plurality of discrete components, and said inner section and impeller both being removable from said housing by way of said sealable opening, at least one of said sections constituting a bend and said inner section serving to accelerate the flow of fluid from said outer section toward said impeller.

4. In a centrifugal pump, particularly in a primary recirculating pump for use in pressurized water and boiling water nuclear reactors, a combination comprising a substantially spherical hollow pump housing having a sealable opening; an impeller rotatable in said housing; an inlet having an outer section which is rigid with said housing and inclined with respect to the axis of said impeller and which has a discharge port for inflowing fluid, and a discrete inner section installed in said housing to receive inflowing fluid from said discharge port of said outer section and to convey the fluid into the range of said impeller, said inner section comprising a plurality of axially adjacent communicating tubular portions, said impeller and said inner section of said inlet being removable from said housing by way of said opening; an outlet for conveying pressurized fluid from said housing, the plane of said discharge port of said outer section of said inlet being at least closely adjacent to said outlet; and annular sealing means interposed between neighboring tubular portions of said inner section.

5. In a centrifugal pump, particularly in a primary recirculating pump for use in pressurized-water and boiling-water reactors, a combination comprising a substantially spherical hollow pump housing having a circumferential wall provided with an inlet opening, a sealable opening substantially opposite said inlet opening and an outlet opening intermediate said sealable opening and said inlet opening and being at least close to the plane of the latter; an impeller rotatable in said housing inwardly adjacent said sealable opening and spaced from said inlet opening; and an inlet structure having an outer section which is rigid with said housing and inclined with respect to the axis of said impeller and which communicates with the said inlet opening at the outer side of said housing, and a discrete inner section installed in said housing in communication with said inlet opening and having a flow passage extending from said wall towards said impeller, and at least in part converging in direction towards said impeller to convey incoming fluid into the range of the same, said inner section comprising a plurality of axially adjacent communicating tubular portions at least one of which consists of a plurality of discrete components, and said inner section and impeller both being removable from said housing by way of said sealable opening, said components being substantially semicylindrical shells and said inner section comprising sealing means interposed between said shells.

6. In a centrifugal pump, particularly in a primary recirculating pump for use in pressurized water and boiling water nuclear reactors, a combination comprising a substantially spherical hollow pump housing having a sealable opening; an impeller rotatable in said housing; an inlet having an outer section which is rigid with said housing and inclined with respect to the axis of said impeller and which has a discharge port for inflowing fluid, and a discrete inner section installed in said housing to receive inflowing fluid from said discharge port of said outer section and to convey the fluid into the range of said impeller, said inner section comprising a plurality of axially adjacent communicating tubular portions, said impeller and said inner section of said inlet being removable from said housing by way of said opening; an outlet for conveying pressurized fluid from said housing, the plane of said discharge port of said outer section of said inlet being at least closely adjacent to said outlet; and further comprising annular sealing means interposed between said outer section and said housing on the one hand, and one end of said inner section on the other hand.

7. In a centrifugal pump, particularly in a primary recirculating pump for use in pressurized water and boiling water nuclear reactors, a combination comprising a substantially spherical hollow pump housing having a sealable opening; an impeller rotatable in said housing; an inlet having an outer section which is rigid with said housing and inclined with respect to the axis of said impeller and which has a discharge port for inflowing fluid, and a discrete inner section installed in said housing to receive inflowing fluid from said discharge port of said outer section and to convey the fluid into the range of said impeller, said inner section comprising a plurality of axially adjacent communicating tubular portions, said impeller and said inner section of said inlet being removable from said housing by way of said opening; annular guide means disposed in said housing and arranged to direct pressurized fluid from said impeller into said chamber, at least a portion of said guide means being separably connected with said housing and being removable from said housing by way of said sealable opening to thereby facilitate removal and reinsertion of said inner section; an outlet for conveying pressurized fluid from said housing, the plane of said discharge port of said outer section of said inlet being at least closely adjacent to said outlet, said housing having a chamber for pressurized fluid, and said chamber surrounding said inner section and communicating with said outlet.

8. A combination as defined in claim 7, wherein said guide means surrounds said impeller and is sealingly connected with one end of said inner section.

9. A combination as defined in claim 7, wherein said separable portion of said guide means extends into said sealable opening so that said sealable opening is enlarged upon removal of said separable portion from said housing.

* * * * *